US009252537B2

(12) United States Patent
Cox et al.

(10) Patent No.: US 9,252,537 B2
(45) Date of Patent: Feb. 2, 2016

(54) RETAINING AN ELECTRICAL CABLE TO A POWER STRIP

(71) Applicant: INTERNATIONAL BUSINESS MACHINES CORPORATION, Armonk, NY (US)

(72) Inventors: Aaron R. Cox, Tucson, AZ (US); Zhen De Fu, Shanghai (CN); Lei R. Li, Shanghai (CN); Ming G. Yang, Shanghai (CN)

(73) Assignee: International Business Machines Corporation, Armonk, NY (US)

( * ) Notice: Subject to any disclaimer, the term of this patent is extended or adjusted under 35 U.S.C. 154(b) by 92 days.

(21) Appl. No.: 14/151,883

(22) Filed: Jan. 10, 2014

(65) Prior Publication Data

US 2015/0200489 A1 Jul. 16, 2015

(51) Int. Cl.

| | |
|---|---|
| ***H01R 13/62*** | (2006.01) |
| ***H01R 13/639*** | (2006.01) |
| ***H01R 13/516*** | (2006.01) |

(52) U.S. Cl.

CPC ..... *H01R 13/639* (2013.01); *H01R 13/516* (2013.01)

(58) Field of Classification Search

CPC ..... H01R 13/639; H01R 13/516

USPC ..... 439/372, 373, 371

See application file for complete search history.

(56) References Cited

U.S. PATENT DOCUMENTS

| | | | | |
|---|---|---|---|---|
| 5,336,107 | A | 8/1994 | Sheryll | |
| 7,101,215 | B2 | 9/2006 | Woellner et al. | |
| 7,455,546 | B1 | 11/2008 | Yoon et al. | |
| 2008/0076291 | A1 * | 3/2008 | Ewing et al. | 439/373 |

* cited by examiner

*Primary Examiner* — Abdullah Riyami
*Assistant Examiner* — Nelson R Burgos-Guntin
(74) *Attorney, Agent, or Firm* — Matthew C. Zehrer

(57) ABSTRACT

A rotating retention fixture for preventing the undesired removal of an electrical cable from a power strip includes a pronged clip, a first bracket, a second bracket each rotatable about a central axis and a fastener that restricts rotation between the first rotatable bracket and the second rotatable bracket. In order to prevent the undesired removal of the electrical cable from the power strip, the electrical cable may be inserted into the pronged clip, the rotating retention fixture may be positioned such that a bottom surface of the pronged clip is adjacent to the electrical cable, a first bracket and a second bracket of the rotating retention fixture may be rotated about the central axis to contact opposing sides of the power strip, respectively, and the fastener may be engaged to prevent rotation between the first bracket and the second bracket to retain the electrical cable to the power strip.

20 Claims, 7 Drawing Sheets

RETAINING AN ELECTRICAL CABLE TO A POWER STRIP

FIELD

Embodiments of invention generally relate to electrical device cables and power strips, and more particularly to preventing undesired removal of electrical cables from power strips.

DESCRIPTION OF THE RELATED ART

A power strip is a block of electrical sockets attached to a cable with a main plug on the distal end that allows multiple electrical devices to be powered from a single electrical socket. Power strips are often used when many proximate electrical devices outnumber the available electrical sockets, e.g. audio/video systems, computer systems, etc. The main plug of each electrical device may be inserted into the power strip sockets and, e.g., the main plug of the power strip may be inserted into an available socket to supply power to the connected electrical devices.

Often times, electrical cables of the various electrical devices connected to the power strip may become unintentionally disconnected. Therefore, improvements are desired to prevent the undesired removal of electrical cables from power strips.

SUMMARY

In a first embodiment of the present invention, a method for retaining a electrical cable to a power strip with a rotating retention fixture in order to prevent the undesired removal of the electrical cable from the power strip includes: inserting the electrical cable into a pronged clip of the rotating retention fixture; positioning the rotating retention fixture such that a bottom surface of the pronged clip is adjacent to the electrical cable; rotating a first bracket of the rotating retention fixture and rotating a second bracket of the rotating retention fixture about a shared axis that is perpendicular to the power strip, and; engaging a fastener of the rotating retention fixture to prevent relative movement between the first bracket and the second bracket to retain the electrical cable to the power strip.

In another embodiment of the present invention, the rotating retention fixture for retaining and preventing the undesired removal of the electrical cable from the power strip includes: a pronged clip rotatable about a central axis, a first bracket rotatable about the central axis, a second bracket rotatable about the central axis, and a fastener that restricts relative rotation between the first rotatable bracket and the second rotatable bracket. The pronged clip includes a central support, a first prong extending from the central support in a direction perpendicular to the central axis, and a second prong extending from the central support in a direction perpendicular to the central axis. The first bracket and the second bracket, each respectively, includes a central support, a horizontal bracket extending from the central support in a direction perpendicular to the central axis, and a vertical bracket extending downward from a distal end of the horizontal bracket.

In yet another embodiment of the present invention, a method for retaining the electrical cable to the power strip with a sliding retention fixture to prevent the undesired removal of the electrical cable from the power strip includes: inserting a electrical cable into an opening of the sliding retention fixture; positioning sliding retention fixture such that an extension bracket of the sliding retention fixture is adjacent the electrical cable; sliding a first bracket of the sliding retention fixture against a second bracket of the sliding retention fixture along an axis generally perpendicular to the power strip; contacting opposing sides of the power strip with the first bracket and the second bracket, and' engaging a fastener of the sliding retention fixture to prevent relative movement between the first bracket and the second bracket to retain and prevent the undesired removal of the electrical cable from the power strip.

These and other embodiments, features, aspects, and advantages will become better understood with reference to the following description, appended claims, and accompanying drawings.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION

Figure 1:
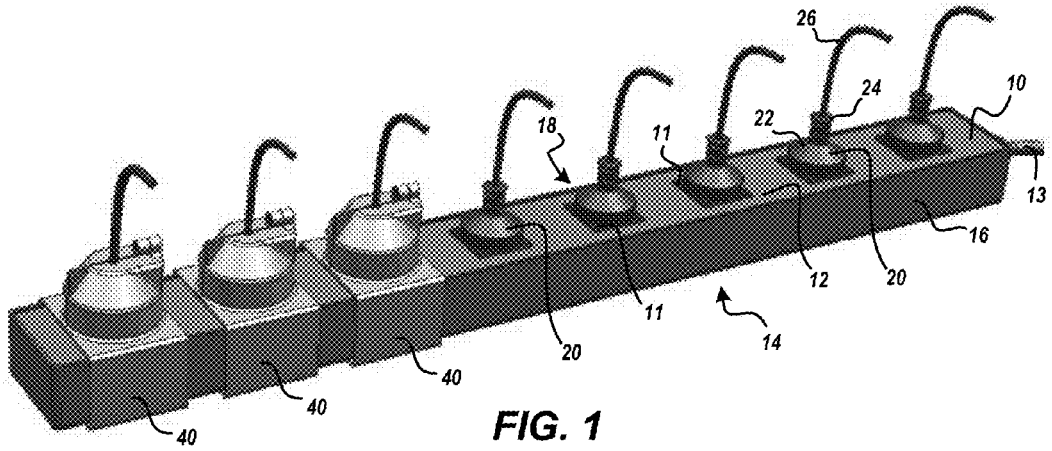
FIG. 1 depicts a power strip and various clam shell electrical cable retainers, according to various embodiments of the present invention.

Details of the claimed embodiments are disclosed herein. However, it is understood that the disclosed embodiments are merely illustrative of the structures, devices, systems, methods, etc. that may be embodied in various forms. These exemplary embodiments are provided so that this disclosure will be thorough and complete and will convey the scope of this invention to those skilled in the art. In the description, details of well-known features and techniques may be omitted to avoid unnecessarily obscuring the presented embodiments.

The drawings are not necessarily to scale. The drawings are merely schematic representations, not intended to portray specific parameters of the invention. The drawings are intended to depict only exemplary embodiments of the invention. In the drawings, like numbering represents like elements.

FIG. 1 depicts a power strip 10 and various clam shell electrical cable retainers 20, according to various embodiments of the present invention. Power strip 10 is a block of electrical sockets 11 attached to a cable 13 with a main plug on the distal end that allows multiple electrical devices to be powered from a single electrical socket. Power strip 10 may be used when many proximate electrical devices outnumber the available electrical sockets, e.g. audio/video systems, computer systems, etc. A main plug of each electrical device may be inserted into the power strip sockets 11 and, e.g., the main plug of the power strip may be inserted into an available socket to supply power to the connected electrical devices. Power strip 10 may include an upper surface 12, bottom surface 14, front surface 16, back surface 18, etc. Electrical devices connected to power strip 10 may include a electrical cable 20 comprising a main plug 22, bend limiter 24, and cord 26. To prevent undesired removal of electrical cable 20, clam shell 40 may be positioned upon electrical cable 20 and power strip 10 to effectively retain electrical cable 20 with power strip 10.

Figure 2:
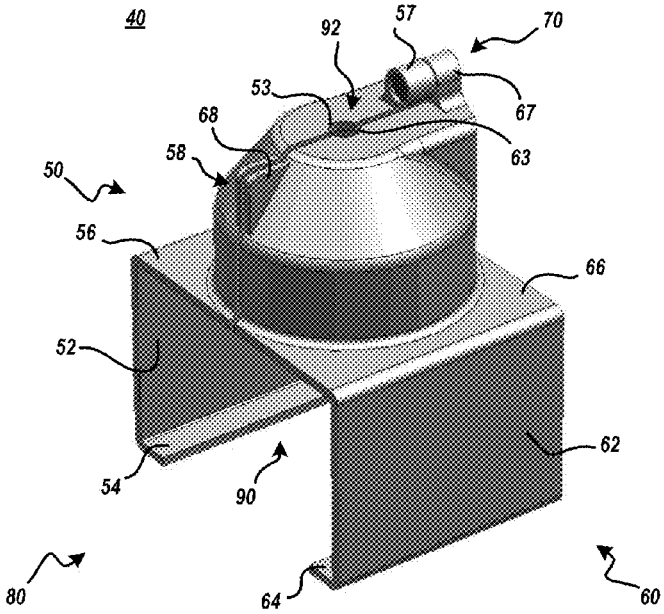
FIG. 2 depicts a more detailed view of a clam shell electrical cable retainer, according to various embodiments of the present invention.

FIG. 2 depicts a more detailed view of a clam shell 40 for retaining electrical cable 20 to power strip 10, according to various embodiments of the present invention. In certain embodiments, clam shell 40 includes a first shell portion 50 and a second shell portion 60. First shell portion 50 and a second shell portion 60 may be connected and rotatable relative to each other via hinge 70. In certain embodiments, hinge 70 provides the first shell portion 50 and second shell portion 60 to rotate relative to each other about an axis substantially parallel (e.g. more parallel than perpendicular, etc.) to power strip 10, upper surface 12, etc. Clam shell 40 may include an opening 80 that accepts power strip 10 by allowing clam shell 40 to overlay upper surface 12, bottom surface 14, front surface 16, back surface 18, etc. when clam shell 40 is engaged with power strip 10. Clam shell 40 may also include a void 90 that accepts electrical cable 20 by allowing clam shell 40 to overlay main plug 22, bend limiter 24, etc. when clam shell 40 is engaged with electrical cable 20. Thus, for example, clam shell 40 may surround at least portions of power strip 10 and electrical cable 20 when clam shell 40 is engaged with power strip 10 and electrical cable 20 and may substantially retain electrical cable 20 to power strip 10. In certain embodiments, clam shell 40 may also include an opening 92 that accepts power cord 26 when clam shell 40 is engaged with electrical cable 20, such that power cord 26 may extend through clam shell 40.

First shell portion 50 may include a sidewall 52, opening portion 53, bottom wall 54, top wall 56, hinge extension 57, and/or locking tab 58. In various embodiments, side wall 52 is configured to overlay e.g. front surface 16, back surface 18, etc. of power strip 10 and thus may have e.g. a height approximately equal to the height, etc. of front surface 16, back surface 18. In various embodiments, bottom wall 54 is configured to overlay e.g. bottom surface 14, portion of bottom surface 14, etc. of power strip 10. In certain embodiments, the width of bottom wall 54 may be approximately half the width of bottom surface 14, less that half the width of bottom surface 14, etc.

In further various embodiments, top wall 56 is configured to overlay e.g. upper surface 12, portion of bottom surface 12, etc. of power strip 10 and, in certain embodiments, may have a width of approximately half the width of power strip 10, etc. Opening portion 53 may be utilized to form opening 92. Hinge extension 57 may be utilized to provide mechanical support and/or retention of hinge 70. Locking tab 58 may be utilized and may include an opening (not shown) such that a pin, lock, or other similar feature may extend therethrough to retain first shell portion 50 and second shell portion 60.

Second shell portion 60 may include a sidewall 62, opening portion 63, bottom wall 64, top wall 66, hinge extension 67, and/or locking tab 68. In various embodiments, side wall 62 is configured to overlay e.g. front surface 16, back surface 18, etc. of power strip 10 and thus may have e.g. a height approximately equal to the height, etc. of front surface 16, back surface 18. In various embodiments, bottom wall 64 is configured to overlay e.g. bottom surface 14, portion of bottom surface 14, etc. of power strip 10. In certain embodiments, the width of bottom wall 64 may be approximately half the width of bottom surface 14, less that half the width of bottom surface 14, etc.

In further various embodiments, top wall 66 is configured to overlay e.g. upper surface 12, portion of bottom surface 12, etc. of power strip 10 and, in certain embodiments, may have a width of approximately half the width of power strip 10, etc. Opening portion 63 may be utilized to form opening 92. Hinge extension 67 may be utilized to provide mechanical support and/or retention of hinge 70. Locking tab 68 may be utilized and may include an opening (not shown) such that a pin, lock, or other similar such feature may extend therethrough to retain first shell portion 50 and second shell portion 60.

In certain embodiments, opening portion 53 and opening portion 63 are configured to align when the first shell portion 50 is engaged (e.g. rotated, etc.) with second shell portion 60 to form opening 92. In certain embodiments, hinge extension 57 and hinge extension 67 are configured to align and form a sleeve that accepts hinge 70 such that first shell portion 50 is connected to and rotatable relative to second shell portion 60. Further, in certain embodiments, locking tab 58 and locking tab 68 are configured to align when the first shell portion 50 is engaged (e.g. rotated, etc.) with second shell portion 60 such that locking tab 58 and locking tab 68 may be fixed or otherwise retained together to effectively lock the relative rotation of first shell portion 50 relative to second shell portion 60. Thus, clam shell 40 may be positioned upon electrical cable 20 and power strip 10 and retained to prevent the undesired removal of electrical cable 20 from the power strip 10.

In certain embodiments, first shell portion 50 and a second shell portion 60 may each be effectively half of clam shell 40 (e.g. dimension of top wall 56 is equal to dimension of top wall 66, etc.). In other embodiments a particular shell portion may comprise the majority of clam shell 40 (e.g. dimension of top wall 56 is greater than dimension of top wall 66, etc.), etc. In certain embodiments, first shell portion 50, second shell portion 60, etc. may be made from molded plastic, etc.

Figure 3:
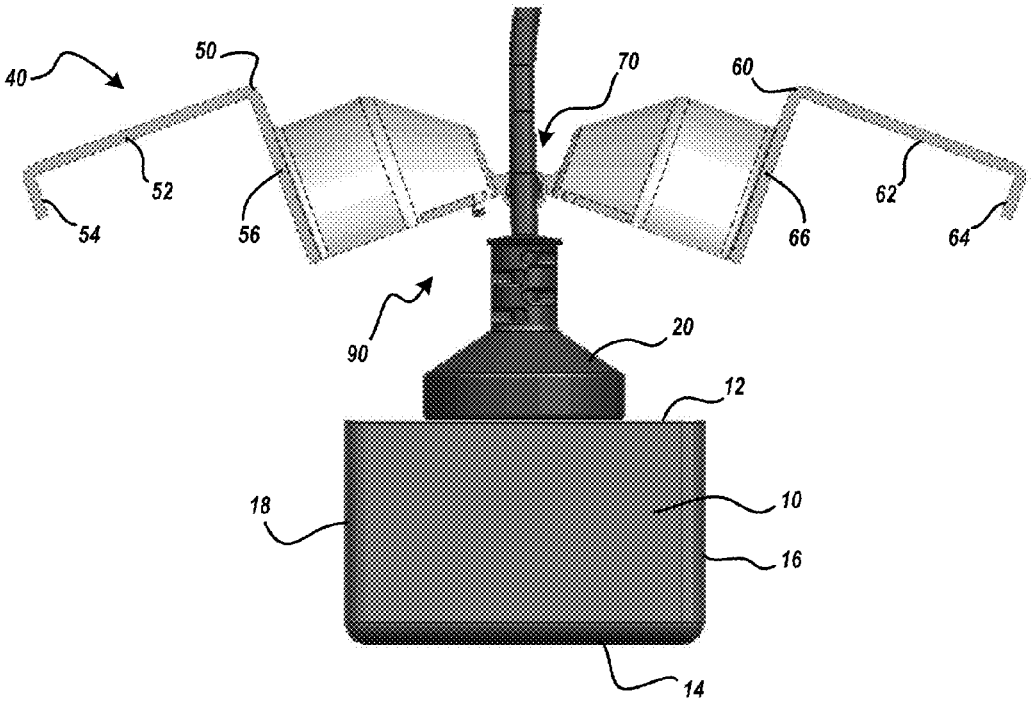
FIG. 3 depicts a power strip and an open clam shell electrical cable retainer positioned upon an electrical cable, according to various embodiments of the present invention.

FIG. 3 depicts power strip 10 and an open clam shell electrical cable retainer 40 positioned upon electrical cable 20. In certain embodiments, clam shell 40 is positioned upon electrical cable 20 and power strip 10 such that when first shell portion 50 and second shell portion 60 are rotated about hinge 70, top wall 56 and top wall 66 overlay upper surface 12, sidewall 52 overlays back surface 18, sidewall 62 overlays front surface 16, bottom wall 54 and bottom wall 64 overlay bottom surface 14, etc.

Figure 4:
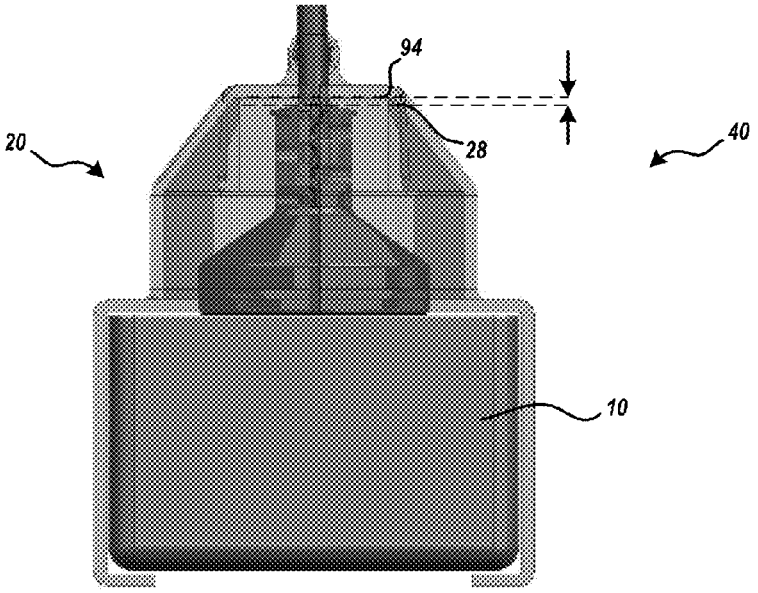
FIG. 4 depicts a clam shell electrical cable retainer positioned upon an electrical cable and power strip to prevent the undesired removal of the electrical cable from the power strip, according to various embodiments of the present invention.

FIG. 4 depicts a clam shell electrical cable retainer 40 positioned upon electrical cable 20 and power strip 10 to prevent the undesired removal of electrical cable 20 from power strip 10, according to various embodiments of the present invention. In certain embodiments, clam shell 40 is configured such that an upper wall 98 is coincident with a top surface 28 of electrical cable 20 such that electrical cable 20 is effectively retained to power strip 10 when clam shell 40 is positioned thereupon. In various embodiments there may be a gap between upper wall 98 and top surface 28. The gap may be less than the wipe of main plug 22 pins and power strip 10 receptacles, so as to retain electrical cable 20 to power strip 10 when clam shell 40 is positioned thereupon.

Figure 5:
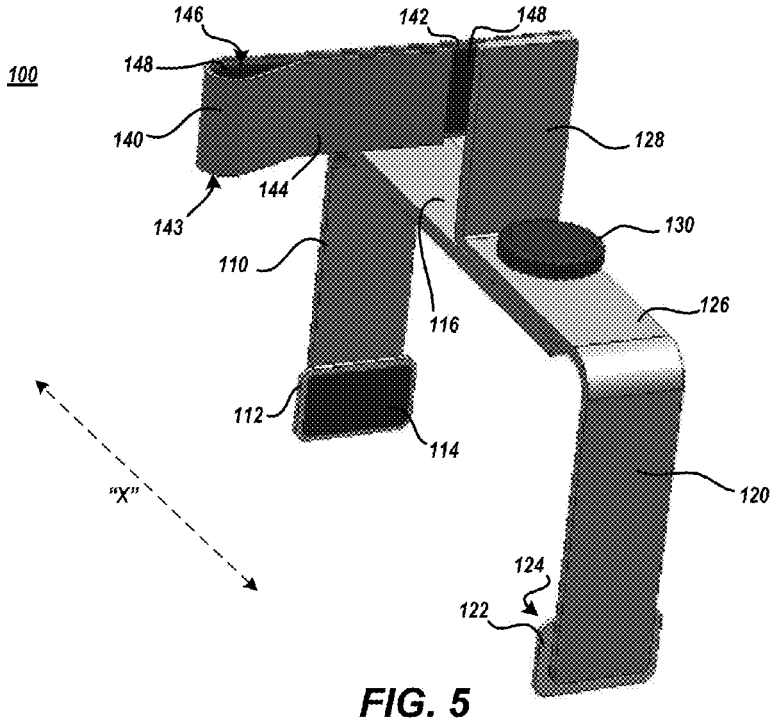
FIG. 5 depicts a sliding retention fixture for retaining an electrical cable to a power strip, according to various embodiments of the present invention.

FIG. 5 depicts sliding retention fixture 100 for retaining electrical cable 20 to power strip 10, according to various embodiments of the present invention. Sliding retention fixture 100 may include a first bracket 110 and a second bracket 120 slideable relative thereto in a general direction "X". In certain embodiments, direction "X" may be generally perpendicular to power strip 10. In various embodiments, first bracket 110 and second bracket 120 may be fixed or retained relative to each other by engaging fastener 130.

First bracket 110 may include a foot portion 112, side wall 115, and upper wall 116. In various embodiments, a grip layer 114 (e.g. rubber, etc.) may be included upon foot portion 112. In various embodiments, upper wall 116 may include a slot to provide slidable movement to second bracket 120. Foot portion 112 may engage with front surface 16 of power strip 10. In various embodiments upper wall 116 is substantially perpendicular to side wall 115. In certain embodiments, an angle between upper wall 116 and side wall 115 may be less than ninety degrees, etc. Though shown as additional component, in certain embodiments, foot portion 112 may be integral to sidewall 115. In various embodiments, first bracket 110 is generally an "L" shaped bracket and may be made from e.g. sheet metal, etc.

Second bracket 120 may include a foot portion 122, side wall 125, upper wall 126 and center wall 128. In various embodiments, a grip layer 124 (e.g. rubber, etc.) may be included upon foot portion 122. In various embodiments, upper wall 126 may include a hole, slot, etc. to provide slidable movement relative to first bracket 110. For example, upper wall 124 may include a hole that accepts fastener 130, etc. Foot portion 122 may engage with back surface 18 of power strip 10. In various embodiments upper wall 126 is substantially perpendicular to side wall 125. In certain embodiments, an angle between upper wall 126 and side wall 125 may be less than ninety degrees, etc. Though shown as additional component, in certain embodiments, foot portion 122 may be integral to sidewall 125. In various embodiments, sidewall 125 and upper wall 126 may be generally an "L" shaped bracket, etc.

In various embodiments, a center wall 128 may extended from the distal end of upper wall 126, relative to sidewall 125. In certain embodiments, center wall 128 is generally parallel to sidewall 125 and may be generally perpendicular to power strip 10. In certain embodiments, center wall 128 is arranged such that it is the center of sliding retention fixture 100 when foot portion 122 is separated from foot portion 112 by a dimension equal to the distance between front surface 16 and back surface 18.

In various embodiments, an engagement bracket 140 may generally extend sideward from the distal end of center wall, relative to upper wall 126. Engagement bracket 140 may generally engage with electrical cable 20. Engagement bracket 140 may include an outward wall 142, inward wall 144, opening 146, etc. In certain embodiments the outward wall 142, inward wall 144, and opening 146 are formed from e.g. sheet metal that may be open hemmed upon itself, etc. In other embodiments, engagement bracket 140 may be molded plastic, etc. Generally, inward wall 144 is flexible relative to outward wall 142 such that power cord 26 may be moved there between to fit within opening 146, etc. In certain embodiments, a protective layer 148 may be included on the inner sides of outward wall 142 and inward wall to protect power cord 26, etc. from damage, wear, etc.

In certain embodiments, foot portion 122 and foot portion 112 engages with power strip 10 and engagement bracket 140 engages with electrical cable 20 (e.g. power cord 26, etc.) so as to so as to retain electrical cable 20 to power strip 10 when sliding retention fixture 100 is positioned thereupon and fastener 130 is engaged. For example, power cord 26 is inserted between outward wall 142 and inward wall 144 to fit within opening 146, sliding retention fixture 100 is positioned such that a bottom surface 143 of engagement bracket 140 is less than a wipe dimension from e.g. bend limiter 24, first bracket 110 and second bracket 120 slide against each other such that foot portion 122 engages with back surface 18, foot portion 112 engages with front surface 16, and fastener 130 is engaged to retain electrical cable 20 to power strip 10.

In certain embodiments, fastener 130 extends through hole, bracket, etc. of the second bracket 120 and the hole, slot, etc. of upper wall 116 to loosely retain first bracket 110, second bracket 120, etc. and, when engaged, forces first bracket 110 and second bracket 120 together to restrict relative movement there between. In certain embodiments, fastener 130 may include a backside fastener portion on e.g. the underside of upper wall 116. For example, fastener 130 may include a screw portion accessible above upper wall 126 that may engage with a threaded receptacle on the underside of upper wall 116.

Figure 6:
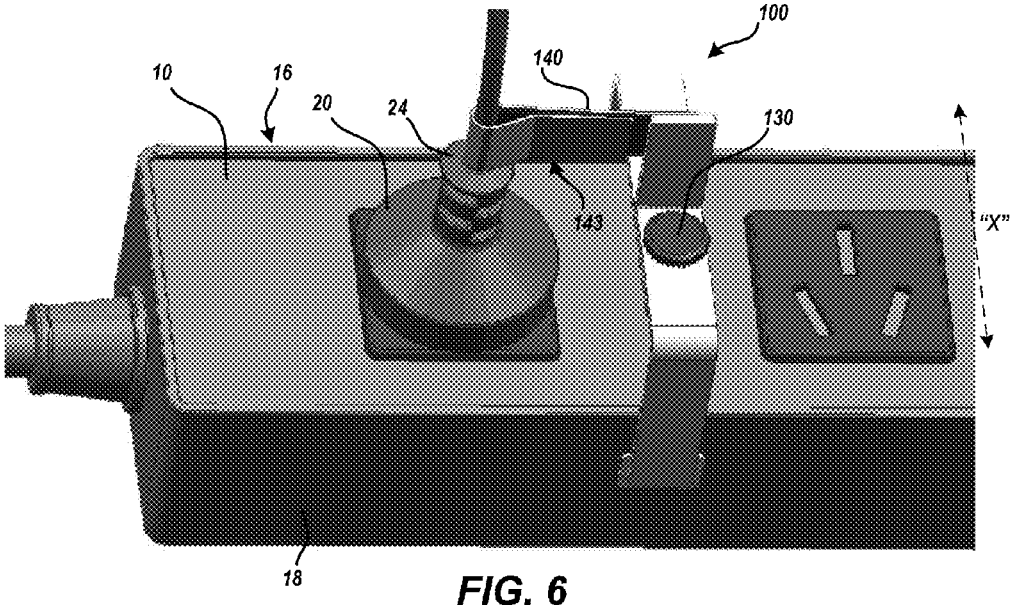
FIG. 6 depicts a sliding retention fixture positioned upon an electrical cable and a power strip to prevent the undesired removal of the electrical cable from the power strip, according to various embodiments of the present invention.

FIG. 6 depicts sliding retention fixture 100 positioned upon electrical cable 20 and power strip 10 to prevent the undesired removal of electrical cable 20 from power strip 10, according to various embodiments of the present invention. Power cord 26 may be inserted between outward wall 142 and inward wall 144 of extension bracket 140 such that power cord generally lies within opening 146. Sliding retention fixture 100 may be positioned vertically upon power strip 10 such that bottom surface 143 of engagement bracket 140 is coincident with top surface 28 of electrical cable 20. In certain embodiments, sliding retention fixture 100 may be positioned vertically upon power strip 10 such that there is a gap between bottom surface 143 of and top surface 28. The gap may be less than the wipe of main plug 22 pins and power strip 10 receptacles, so as to retain electrical cable 20 to power strip 10 when sliding retention fixture 100 is positioned thereupon. First bracket 110 and second bracket 120 may slide against each other to engage foot portion 122 with back surface 18 and to engaged foot portion 112 with front surface 16. Fastener 130 may be engaged to retain sliding retention fixture 100 with e.g. power strip 10 in order to prevent the undesired removal of electrical cable 20 from power strip 10.

Figure 7:
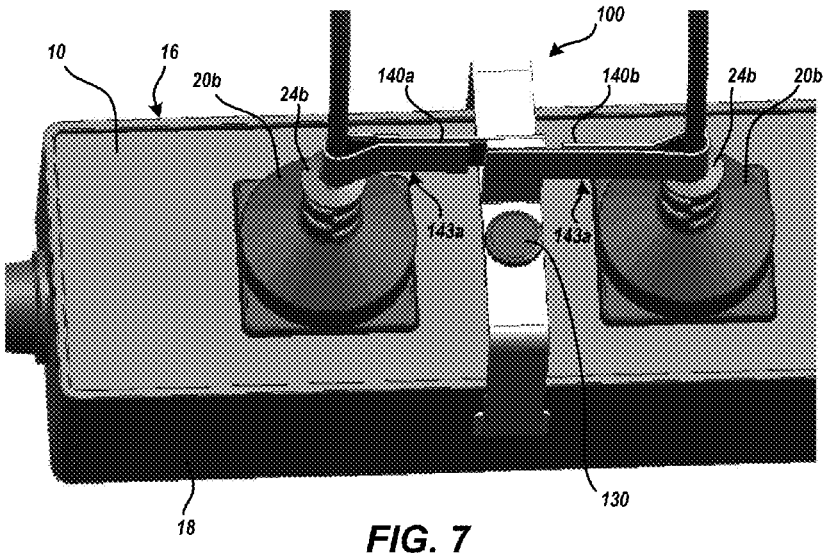
FIG. 7 depicts a sliding retention fixture positioned upon multiple electrical cables and a power strip to prevent the undesired removal of multiple electrical cables from the power strip, according to various embodiments of the present invention.

FIG. 7 depicts sliding retention fixture 100 positioned upon multiple electrical cables 20 and power strip 10 to prevent the undesired removal of multiple electrical cables 20 from the power strip 10. In various embodiments, sliding retention fixture 100 may include multiple extension brackets 140*a*, 140*b*, etc. For example, a first power cord 26*a* may be inserted between outward wall 142*a* and inward wall 144*a* of a first extension bracket 140*a* such that power cord 26*a* generally lies within opening 146*a*. A second power cord 26*b* may be inserted between outward wall 142*a* and inward wall 144*a* of a second extension bracket 140*b* such that power cord 26*b* generally lies within opening 146*b*. Sliding retention fixture 100 may be positioned vertically upon power strip 10 such that bottom surface 143*a* of engagement bracket 140*a* and bottom surface 143*b* of engagement bracket 140*b* are coincident with top surface 28*a* of electrical cable 20*a* and top surface 28*b* of electrical cable 20*b*. First bracket 110 and second bracket 120 may slide against each other to engage foot portion 122 with back surface 18 and to engaged foot portion 112 with front surface 16. Fastener 130 may be engaged to retain sliding retention fixture 100 with e.g. power strip 10 in order to prevent the undesired removal of electrical cable 20*a* and electrical cable 20*b* from power strip 10

Figure 8A:
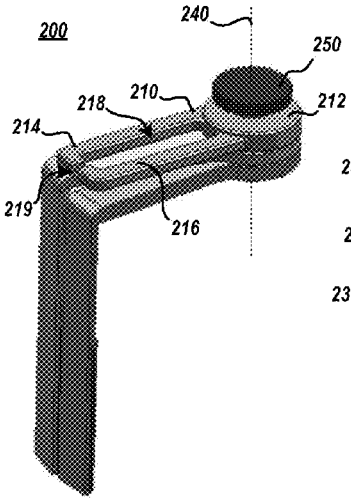
FIG. 8A-8C depict a rotating retention fixture for retaining an electrical cable to a power strip, according to various embodiments of the present invention.
Figure 8B:
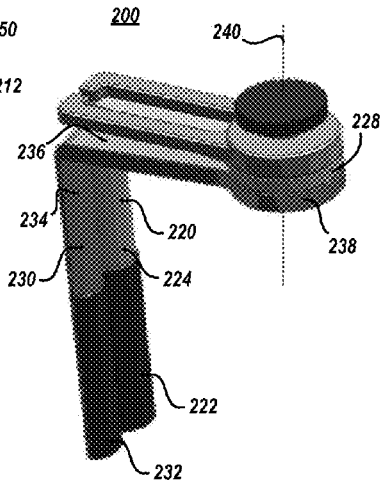
Figure 8C:
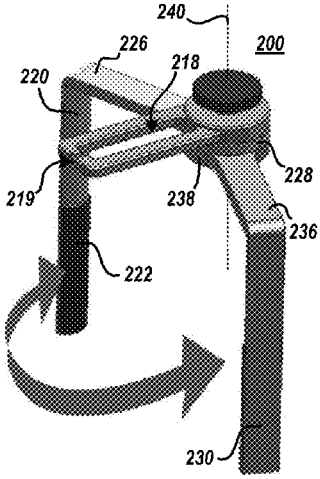

FIG. 8A-8C depict rotating retention fixture 200 for retaining electrical cable 20 to a power strip 10, according to various embodiments of the present invention. Rotating retention fixture 200 may include a first bracket 220 and a second bracket 230 rotatable relative to one another about an axis 240. In certain embodiments, axis 240 may be generally perpendicular to power strip 10. In various embodiments, first bracket 220 and second bracket 230 may be fixed or retained relative to one another by engaging fastener 250. In certain embodiments, rotating retention fixture 200 may also include pronged clip 210 that is rotatable relative first bracket 220 and second bracket 230 about axis 240.

Pronged clip 210 may include a central support 212 that which fastener 250 may extend, engage, etc. In certain embodiments, central support 212 may be generally circular. Pronged clip 210 may also include a first prong 214 and a second prong 216. Prong 214 and prong 216 may extend from central support 212. Prong 214 and prong 216 may be arranged, separated, etc. such that a perpendicular opening 218 and a parallel opening 219 are formed there between. Perpendicular opening 219 may be a generally rectangular opening (e.g. width greater than height, etc.), relative to central support 212, and may have a height that is greater than the diameter of power cord 26. Parallel opening 219 may be an opening between the distal ends of prong 214 and cord 216, relative to central support 212. The width of parallel opening 219 between prong 214 and prong 216 may be less than the diameter of power cord 26. In certain embodiments, pronged clip 210 may be made from molded plastic. Therefore, prong 216 and prong 216 may be flexible relative to central support 212. As such, in certain embodiments, prong 214, prong 216 may be flexed such that the width of parallel opening 219 between prong 214 and prong 216 may become greater than the diameter of power cord 26, to allow power cord 26 to be inserted into opening 218. Prong 214 and/or prong 216 may return to an un-flexed state and the width of parallel opening 219 between prong 214 and prong 216 returns to less than the diameter of power cord 26 and electrical cable 20 may be retained within opening 218. In certain embodiments, pronged clip 210 may be made from e.g. molded plastic, etc.

First bracket 220 may include a central support 228 that which fastener 250 may extend, engage, etc. In certain embodiments, central support 228 may be generally circular. First bracket 220 may also include a horizontal bracket 226 extending from central support 228. First bracket 220 may also include a vertical bracket 224 extending downward from the distal end of bracket 226, relative to central support 228. In certain embodiments, bracket 226 and bracket 228 may include a beveled, chamfered, etc. inner wall and a generally flat outer wall, etc., respectively. In certain embodiments, first bracket 220 may include a grip layer (e.g. rubber, etc.) 222 upon bracket 224, a portion of bracket 224, etc.

Second bracket 230 may include a central support 238 that which fastener 250 may extend, engage, etc. In certain embodiments, central support 238 may be generally circular. Second bracket 230 may also include a horizontal bracket 236 extending from central support 238. Second bracket 230 may also include a vertical bracket 234 extending downward from the distal end of bracket 236, relative to central support 238. In certain embodiments, bracket 236 and bracket 238 may include a beveled, chamfered, etc. inner wall and a generally flat outer wall, etc., respectively. In certain embodiments, second bracket 230 may include a grip layer (e.g. rubber, etc.) 232 upon bracket 234, a portion of bracket 234, etc.

In certain embodiments, first bracket 220 and second bracket 230 may be "L" shaped brackets and may be made from e.g. molded plastic, etc.

In certain embodiments, fastener 250 extends through a hole, opening, etc. of pronged clip 210, bracket 220, and bracket 230 and, when engaged, forces pronged clip 210, bracket 220, and bracket 230 together to restrict relative movement there between. In certain embodiments, fastener 250 may include a backside fastener portion on e.g. the underside of central support 238. For example, fastener 250 may include a screw portion (e.g. thumb screw head, etc.) accessible above pronged clip 210 that may engage with a threaded receptacle on the underside of central support 238.

Figure 9:
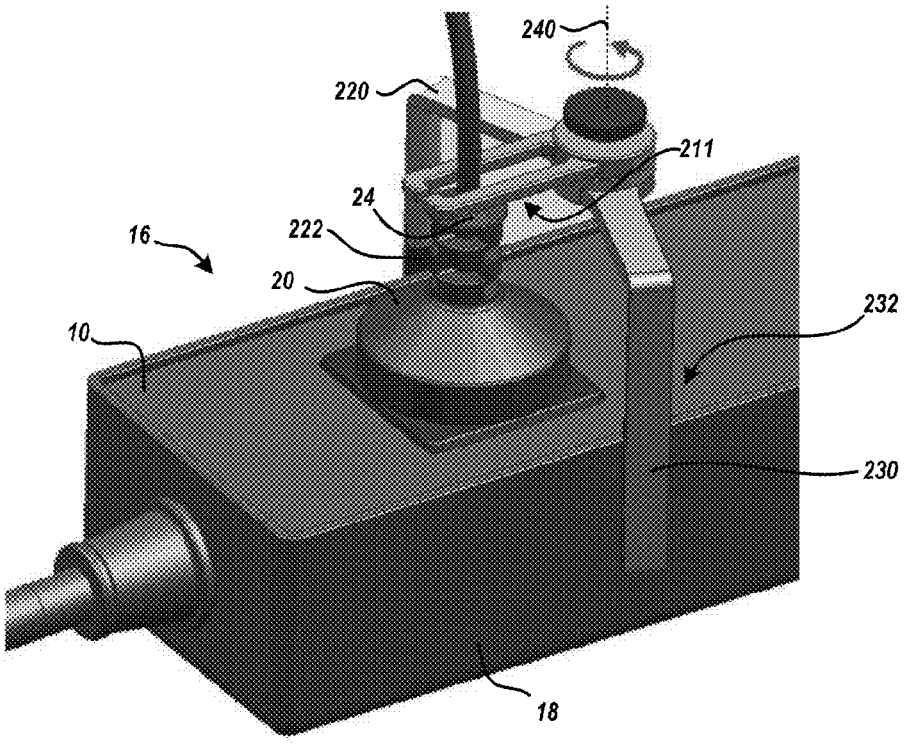
FIG. 9 depicts a rotating retention fixture positioned upon an electrical cable and a power strip to prevent the undesired removal of the electrical cable from the power strip, according to various embodiments of the present invention.

FIG. 9 depicts rotating retention fixture 200 positioned upon electrical cable 20 and power strip 10 to prevent the undesired removal of electrical cable 20 from the power strip 10, according to various embodiments of the present invention. Power cord 26 may be inserted into opening 218 by flexing e.g. prong 214 to increase the width of opening 219 to a dimension greater than the diameter of power cord 26. Rotating retention fixture 200 may be positioned vertically upon power strip 10 such that a bottom surface 211 of pronged clip 210 is coincident with top surface 28 of electrical cable 20. In certain embodiments, rotating retention fixture 200 may be positioned vertically upon power strip 10 such that there is a gap between bottom surface 211 of and top surface 28. The gap may be less than the wipe of main plug 22 pins and power strip 10 receptacles, so as to retain electrical cable 20 to power strip 10 when rotating retention fixture 200 is positioned thereupon. First bracket 220 and second bracket 230 may rotate relative to each other about axis 240 to e.g. engage vertical bracket 234 with back surface 18 and to engage and vertical bracket 224 with front surface 16. Fastener 250 may be engaged (e.g. rotated about axis 240, etc.) to retain rotating retention fixture 200 with e.g. power strip 10 in order to prevent the undesired removal of electrical cable 20 from power strip 10.

In certain embodiments, rotating retention fixture 200 may include and additional pronged clip 210*b*, etc. Or in other embodiments, pronged clip 210 may include additional prongs to retain additional electrical cables 20. For example, power cord 26*a* may be inserted into opening 218*a* by flexing e.g. prong 214*a* to increase the width of opening 219*a* to a dimension greater than the diameter of power cord 26*a*. A second power cord 26*b* may be inserted into an opening 218*b* by flexing e.g. prong 214*b* to increase the width of an opening 219*b* to a dimension greater than the diameter of the second power cord 26*b*. Rotating retention fixture 200 may be positioned vertically upon power strip 10 such that a bottom surface 211*a* of pronged clip 210*a* is coincident with top surface 28*a* of electrical cable 20*a* and a bottom surface 211*b* of pronged clip 210*b* is coincident with top surface 28*b* of electrical cable 20*b*. In certain embodiments, rotating retention fixture 200 may be positioned vertically upon power strip 10 such that there is a gap between bottom surfaces 211*a*, 211*b* of top surfaces 28*a*, 28*b*, respectively. First bracket 220 and second bracket 230 may rotate relative to each other about axis 240 to e.g. engage vertical bracket 234 with back surface 18 and to engage and vertical bracket 224 with front surface 16. Fastener 250 may be engaged (e.g. rotated about axis 240, etc.) to retain rotating retention fixture 200 with e.g. power strip 10 in order to prevent the undesired removal of the first electrical cable 20*a* and the second electrical cable 20*b* from power strip 10.

Figure 10:
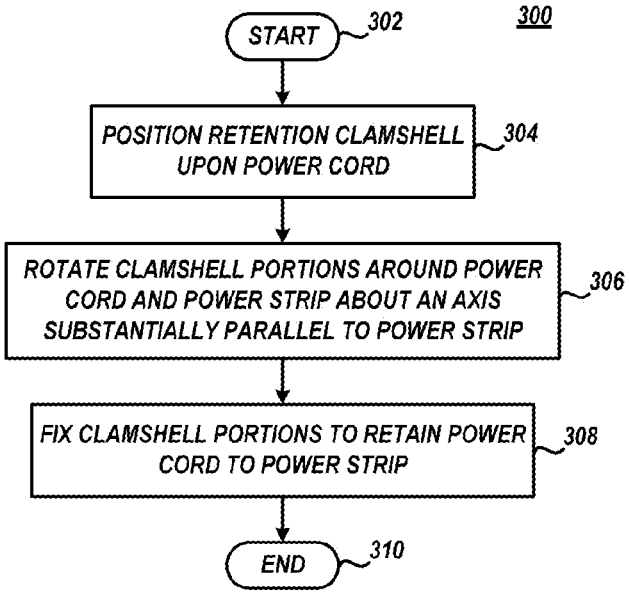
FIG. 10 depicts a block diagram of a method of retaining an electrical cable to a power strip with a clam shell retainer to prevent the undesired removal of the electrical cable from the power strip, according to various embodiments of the present invention.

FIG. 10 depicts a block diagram of a method 300 of retaining electrical cable 20 to power strip 10 with clam shell retainer 40 to prevent the undesired removal of electrical cable 20 from power strip 10, according to various embodiments of the present invention. Method 300 begins at block 302 and continues with positioning clam shell 40 upon power cord 26, main plug 22, etc. (block 304). In certain embodiments, clam shell 40 is positioned upon electrical cable 20 and power strip 10 such that when first shell portion 50 and second shell portion 60 are rotated about hinge 70, top wall 56 and top wall 66 overlay upper surface 12, sidewall 52 overlays back surface 18, sidewall 62 overlays front surface 16, bottom wall 54 and bottom wall 64 overlay bottom surface 14, etc.

Method 300 continues with rotating clam shell portions, e.g. first shell portion 50 and second shell portion 60, utilizing hinge 70, about an axis that is substantially parallel to power strip 10 (block 306). In certain embodiments, when rotated clam shell 40 engages power strip 10 and electrical cable 26 such that an upper wall 98 is coincident with a top surface 28 of electrical cable 20 so that electrical cable 20 is effectively retained to power strip 10 when clam shell 40 is positioned thereupon. Top wall 56 and top wall 66 may overlay upper surface 12, sidewall 52 may overlay back surface 18, sidewall 62 may overlay front surface 16, bottom wall 54 and bottom wall 64 may overlay bottom surface 14, etc.

Method 300 continues by fixing the clam shell portions to retain electrical cable 20 with power strip 10 (block 308). For example, locking tab 58 and locking tab 68 align when the first shell portion 50 is engaged (e.g. rotated, etc.) with second shell portion 60 such that locking tab 58 and locking tab 68 are fixed or otherwise retained together (e.g. by inserting a pin or lock into openings of locking tab 58, 68, respectively) to effectively lock the relative rotation of first shell portion 50 relative to second shell portion 60. Method 300 ends at block 310.

Figure 11:
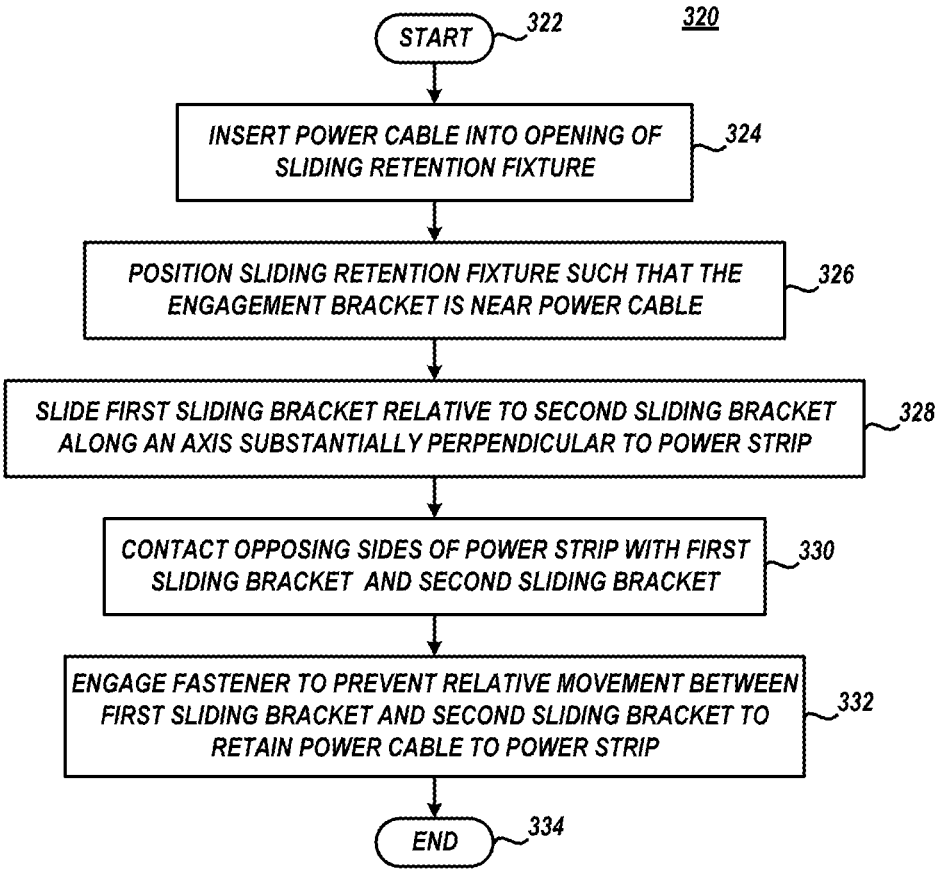
FIG. 11 depicts a block diagram of a method of retaining an electrical cable to a power strip with a sliding retention fixture to prevent the undesired removal of the electrical cable from the power strip, according to various embodiments of the present invention.

FIG. 11 depicts a block diagram of a method 320 of retaining electrical cable 20 to power strip 10 with sliding retention fixture 100 to prevent the undesired removal of electrical cable 20 from power strip 10, according to various embodiments of the present invention. Method 320 begins at block 322 and continues with inserting a electrical cable 20 into opening 146 of sliding retention fixture 100 (block 324). For example, power cord 26 may be inserted between outward wall 142 and inward wall 144 of extension bracket 140 such that power cord 26 generally lies within opening 146.

Method 320 continues with positioning sliding retention fixture so that extension bracket 140 is near the electrical cable 20 (block 326). For example, sliding retention fixture 100 may be positioned vertically upon power strip 10 such that bottom surface 143 of engagement bracket 140 is coincident with top surface 28 of electrical cable 20. In certain embodiments, sliding retention fixture 100 may be positioned vertically upon power strip 10 such that there is a gap between bottom surface 143 of and top surface 28. The gap may be less than the wipe of main plug 22 pins and power strip 10 receptacles, so as to retain electrical cable 20 to power strip 10 when sliding retention fixture 100 is positioned thereupon.

Method 320 continues with sliding first bracket 110 and second bracket 120 against each other along an axis substantially perpendicular to power strip 10 (block 328). Method 320 continues with contacting opposing sides of power strip 10 with first bracket 110 and second bracket 120 (block 330). For example, first bracket 110 and second bracket 120 slide against each other to engage foot portion 122 with back surface 18 and to engage foot portion 112 with front surface 16.

Method 320 continues by engaging fastener 130 to prevent relative movement between first bracket 110 and second bracket 120 to engage sliding retention fixture 100 with e.g. power strip 10 in order to retain and prevent the undesired removal of electrical cable 20 from power strip 10 (block 332). Method 320 ends at block 334.

Figure 12:
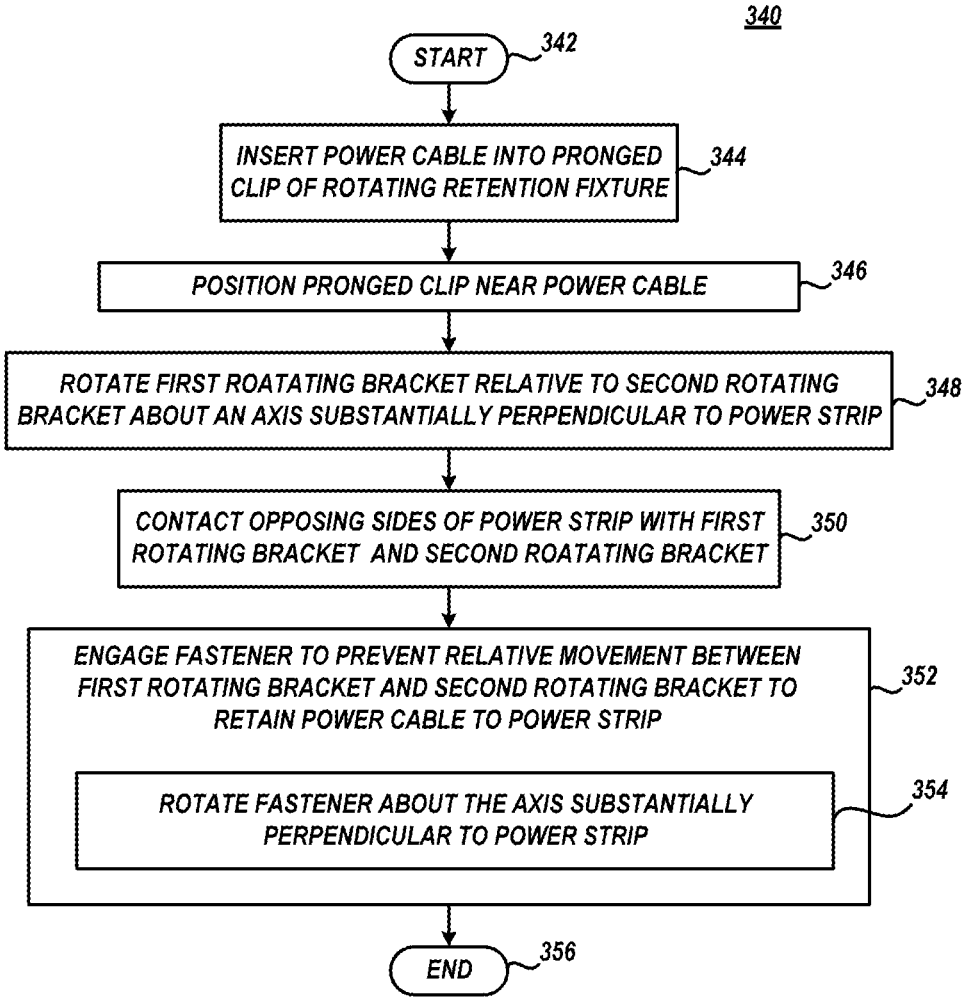
FIG. 12 depicts a block diagram of a method of retaining an electrical cable to a power strip with a rotating retention fixture to prevent the undesired removal of the electrical cable from the power strip, according to various embodiments of the present invention.

FIG. 12 depicts a block diagram of a method 340 of retaining electrical cable 20 to power strip 10 with rotating retention fixture 200 to prevent the undesired removal of electrical cable 20 from power strip 10, according to various embodiments of the present invention. Method 340 begins at block 342 and continues with inserting electrical cable 20 into pronged clip 210 of rotating retention fixture 200 (block 344). For example, power cord 26 may be inserted into opening 218 by flexing e.g. prong 214 to increase the width of opening 219 to a dimension greater than the diameter of power cord 26.

Method 340 continues by positioning pronged clip 210 near electrical cable 20 (block 346). For example, rotating retention fixture 200 may be positioned vertically upon power strip 10 such that a bottom surface 211 of pronged clip 210 is coincident with top surface 28 of electrical cable 20. In certain embodiments, rotating retention fixture 200 may be positioned vertically upon power strip 10 such that there is a gap between bottom surface 211 of and top surface 28. The gap may be less than the wipe of main plug 22 pins and power strip 10 receptacles, so as to retain electrical cable 20 to power strip 10 when rotating retention fixture 200 is positioned thereupon.

Method 340 continues by rotating first bracket 220 and/or second bracket 230 relative to each other about axis substantially perpendicular to power strip 10 (block 348). For example, first bracket 220 may be rotated against second bracket 230 about axis 240. Method 340 continues by contacting opposing sides of power strip 10 with first rotating bracket 220 and with second rotating bracket 230 (block 350). For example, first bracket 220 may be rotated against second bracket 230 about axis 240 to e.g. engage vertical bracket 234 with back surface 18 and to engage and vertical bracket 224 with front surface 16.

Method 340 continues by engaging fastener 250 to prevent relative movement between first bracket 220 and second bracket 230 to retain electrical cable 20 with power strip 10 (block 352). For example, fastener 250 may be rotated about an axis substantially perpendicular to power strip 10 (e.g. axis 240, etc.) to retain rotating retention fixture 200 with e.g.

power strip 10 in order to prevent the undesired removal of electrical cable 20 from power strip 10.

References herein to terms such as "vertical", "horizontal", etc. are made by way of example, and not by way of limitation, to establish a frame of reference. The term "horizontal" as used herein is defined as a plane parallel to the conventional plane or top surface 10 of power strip 10, regardless of the actual spatial orientation of the power strip 10. The term "vertical" refers to a direction perpendicular to the horizontal, as just defined. Terms, such as "on", "above", "below", "side", "top", "bottom", "higher", "lower", "over", "beneath", "under", etc. are defined with respect to the horizontal plane. It is understood that various other frames of reference may be employed for describing the present invention without departing from the spirit and scope of the present invention.

The invention claimed is:

1. A method for retaining a electrical cable to a power strip with a rotating retention fixture to prevent the undesired removal of the electrical cable from the power strip, the method comprising:

inserting the electrical cable into a pronged clip of the rotating retention fixture;

positioning the rotating retention fixture such that a bottom surface of the pronged clip is adjacent to the electrical cable;

rotating a first bracket of the rotating retention fixture relative to the pronged clip and rotating a second bracket of the rotating retention fixture relative to the pronged clip about a shared axis that is perpendicular to the power strip, and;

engaging a fastener of the rotating retention fixture to prevent relative movement between the first bracket and the second bracket to retain the electrical cable to the power strip.

2. The method of claim 1, wherein positioning the rotating retention fixture such that the bottom surface of the pronged clip is adjacent to the electrical cable, further comprises:

positioning the rotating retention fixture so the bottom surface of the pronged clip and an upper surface of the electrical cable is separated by less than a wipe dimension between pins of the electrical cable and receptacles of the power strip.

3. The method of claim 1, wherein positioning the rotating retention fixture such that the bottom surface of the pronged clip is adjacent to the electrical cable, further comprises:

positioning the rotating retention fixture so the bottom surface of the pronged clip and an upper surface of the electrical cable are coincident.

4. The method of claim 1, further comprising:

contacting opposing sides of the power strip with the first rotating bracket and with the second rotating bracket, respectively.

5. The method of claim 4 wherein contacting opposing sides of the power strip with the first rotating bracket and with the second rotating bracket, further comprises:

engaging a vertical bracket of the first rotating bracket with a back surface of the power strip;

engaging a vertical bracket of the second rotating bracket with a front surface of the power strip;

wherein the vertical bracket of the first rotating bracket and the vertical bracket of the second rotating bracket are generally parallel to the shared axis.

6. The method of claim 1, wherein engaging the fastener of the rotating retention fixture, further comprises:

rotating the fastener about the shared axis.

7. The method of claim 1, wherein inserting the electrical cable into the pronged clip of the rotating retention fixture, further comprises:

flexing a first prong of the pronged clip to increase an opening between the first prong and a second prong of the pronged clip to a dimension greater than the diameter of a cord of the electrical cable.

8. A rotating retention fixture for retaining and preventing the undesired removal of a electrical cable from a power strip, the rotating retention fixture comprising:

a pronged clip rotateable about a central axis, the pronged clip comprising a central support, a first prong extending from the central support in a direction perpendicular to the central axis, and a second prong extending from the central support in a direction perpendicular to the central axis;

a first bracket rotateable about the central axis relative to the pronged clip, the first bracket comprising a central support, a horizontal bracket extending from the central support in a direction perpendicular to the central axis, and a vertical bracket extending downward from a distal end of the horizontal bracket;

a second bracket rotateable about the central axis relative to the pronged clip, the second bracket comprising a central support, a horizontal bracket extending from the central support in a direction perpendicular to the central axis, and a vertical bracket extending downward from a distal end of the horizontal bracket, and;

a fastener that restricts relative rotation between the first rotateable bracket, the second rotateable bracket, and the pronged clip.

9. The rotating retention fixture of claim 1, wherein the rotating retention fixture is configured to engage with the electrical cable and with the power strip such that a bottom surface of the pronged clip is adjacent to the electrical cable.

10. The rotating retention fixture of claim 9, wherein the rotating retention fixture is configured to engage with the electrical cable and with the power strip such that a bottom surface of the pronged clip and an upper surface of the electrical cable is separated by less than a wipe dimension between pins of the electrical cable and receptacles of the power strip.

11. The rotating retention fixture of claim 9, wherein the rotating retention fixture is configured to engage with the electrical cable and with the power strip such that a bottom surface of the pronged clip and an upper surface of the electrical cable are coincident.

12. The rotating retention fixture of claim 9, wherein the vertical bracket of the first rotateable bracket and the vertical bracket of the second rotateable bracket are configured to contact opposing sides of the power strip, respectively.

13. The rotating retention fixture of claim 9, wherein the vertical bracket of the first rotating bracket contacts a back surface of the power strip, wherein the vertical bracket of the second rotating bracket contacts a front surface of the power strip, and wherein the vertical bracket of the first rotating bracket and the vertical bracket of the second rotating bracket are generally parallel to the central axis.

14. The rotating retention fixture of claim 9, wherein the fastener restricts relative rotation between the first rotateable bracket and the second rotateable bracket by rotating the fastener about the central axis.

15. The rotating retention fixture of claim 9, wherein the first prong flexes against the central support to increase an opening between the first prong and the second prong to a dimension greater than the diameter of a cord of the electrical cable.

16. The rotating retention fixture of claim 9, wherein the pronged clip further comprises:

a third prong extending from the central support in an opposing direction perpendicular to the central axis relative to the first prong; and a fourth prong extending from the central support in an opposing direction perpendicular to the central axis relative to the second prong.

17. The rotating retention fixture of claim 9, wherein the central support of the pronged clip, the central support of the first rotateable bracket, and the central support of the second rotateable bracket are generally circular.

18. The rotating retention fixture of claim 17, wherein the central support of the pronged clip, the central support of the first rotateable bracket, and the central support of the second rotateable bracket share a similar diameter.

19. A method for retaining a electrical cable to a power strip with a sliding retention fixture to prevent the undesired removal of the electrical cable from the power strip, the method comprising:

inserting a electrical cable into an opening of the sliding retention fixture;

positioning sliding retention fixture such that an extension bracket of the sliding retention fixture is adjacent the electrical cable;

sliding a first bracket of the sliding retention fixture against a second bracket of the sliding retention fixture along an axis generally perpendicular to the length of the power strip and generally parallel to the top of the power strip;

contacting opposing sides of the power strip with the first bracket and the second bracket, and;

engaging a fastener of the sliding retention fixture to prevent relative movement between the first bracket and the second bracket to retain and prevent the undesired removal of the electrical cable from the power strip.

20. The method of claim 19:

wherein inserting a electrical cable into the opening of the sliding retention fixture further comprises: inserting a power cord of the electrical cable between an outward wall of the extension bracket and an inward wall of the extension bracket;

wherein positioning the rotating retention fixture such that the bottom surface of the pronged clip is adjacent to the electrical cable, further comprises: positioning the sliding retention fixture such that a bottom surface of the extension bracket clip and an upper surface of the electrical cable are separated by less than a wipe dimension between pins of the electrical cable and receptacles of the power strip, and;

wherein contacting opposing sides of the power strip with the first bracket and the second bracket further comprises: contacting a foot portion of the first bracket with a back surface of the power strip and contacting a foot portion of the second bracket with a front surface of the power strip.

* * * * *